United States Patent [19]

Levine

[11] Patent Number: 4,892,561

[45] Date of Patent: Jan. 9, 1990

[54] METHYL ETHER FUELS FOR INTERNAL COMBUSTION ENGINES

[76] Inventor: Irving E. Levine, 1 Paper Mill Creek Ct., Novato, Calif. 94947

[21] Appl. No.: 832,263

[22] Filed: Feb. 21, 1986

Related U.S. Application Data

[63] Continuation-in-part of Ser. No. 407,119, Aug. 11, 1982, abandoned.

[51] Int. Cl.[4] ..... C10L 1/32; C10L 1/10

[52] U.S. Cl. ..... 44/51; 44/57; 44/72; 44/77

[58] Field of Search ..... 44/56, 57, 77, 53, 51, 44/72; 568/697; 252/386; 123/1 A

[56] References Cited

U.S. PATENT DOCUMENTS

| | | | |
|---|---|---|---|
| 1,398,948 | 11/1921 | Schreiber | 44/77 |
| 2,132,017 | 11/1938 | Evans | 44/56 |
| 2,240,040 | 4/1941 | Hooton | 44/56 |
| 2,256,627 | 9/1941 | Rosen | 44/77 |
| 2,431,322 | 11/1947 | Goodale | 44/57 |
| 2,472,152 | 6/1949 | Farkas et al. | 44/57 |
| 2,575,543 | 11/1951 | Young | 123/1 A |
| 2,696,806 | 12/1954 | Mingle, Jr. | 123/1 A |
| 3,108,864 | 10/1963 | Barusch | 44/53 |
| 4,207,077 | 6/1980 | Bove et al. | 44/56 |
| 4,378,973 | 4/1983 | Sweeney | 44/57 |

*Primary Examiner*—Jacqueline V. Howard
*Assistant Examiner*—Margaret B. Medley
*Attorney, Agent, or Firm*—Limbach, Limbach & Sutton

[57] ABSTRACT

Fuels for internal combustion engines are described which contain at least 50% by weight of methyl ether.

7 Claims, No Drawings

METHYL ETHER FUELS FOR INTERNAL COMBUSTION ENGINES

This application is a continuation-in-part of application Ser. No. 407,119, filed Aug. 11, 1982 now abandoned.

The purpose of this invention is to provide fuels for internal combustion engines which can replace conventional engine fuels and which have reduced dependence on the availability of petroleum.

It is well known that reserves of petroleum are being depleted by high rates of production and that petroleum will not be available as a major source of energy in the foreseeable future. This problem is of worldwide concern and is especially critical in industrial countries. The United States, Western Europe, and Japan not only require large amounts of energy, but are increasingly dependent on imported petroleum. Petroleum sources are not only limited, but political and economic access problems exist. There are much greater reserves of coal, lignite, oil shale, and natural gas. These are widely distributed and can be used to provide relatively stable and secure sources of energy in the form of liquid fuel.

Methyl alcohol has been porposed as a fuel for internal combustion engines. It is usually manufactured from carbon monoxide and hydrogen, which have historically been obtained in large volume from either natural gas or coal. Carbon monoxide can also be obtained from almost any carbon-containing substance including agricultural and forest products and many waste materials. Early manufacture of methyl alcohol was accomplished by pyrolysis of wood, hence the name wood alcohol. The large supply and wide distribution of raw materials for manufacturing methyl alcohol are responsible to a large degree for its growing use as a fuel for internal combustion engines.

Methyl ether has significant advantages over methyl alcohol as a synthetic fuel suitable for replacing all or a considerable proportion of petroleum fuels for use in internal combustion engines, particularly for use in compression-ignition engines.

Methyl ether ($CH_3$—O—$CH_3$) is a by-product of methyl alcohol manufacture. It can be manufactured from methyl alcohol by an inexpensive catalytic dehydration process as well as directly from carbon monoxide and hydrogen. Its production is independent of the availability of petroleum.

Methyl ether has a higher BTU value than methyl alcohol. Of importance is the fact that methyl ether has a very low toxicity whereas methyl alcohol itself presents a serious health hazard from a practical standpoint if it is distributed, sold, and used in manners similar to those employed for gasoline and diesel fuel.

In the employment of methyl ether as a fuel for diesel engines, it is necessary to take into account the fact that spontaneous ignition of the diesel fuel under the conditions of high compression require ignition characteristics opposite to those required for high octane gasoline. The efficiency of a diesel fuel in this regard is expressed as the cetane number, which bears the same relationship to diesel fuel as octane number does to gasoline. In order to improve the cetane number, it is necessary to improve the ease with which the fuel can be ignited without a spark under the conditions of pressure and temperature existing during the compression cycle in the cylinder of the diesel engine. If a diesel fuel does not inherently possess these characteristics to a sufficient degree, various additives have been proposed to improve the spontaneous ignitability of the fuel.

Methyl ether itself can be used as a diesel fuel but its performance can be improved by a cetane number improving additive. Cetane number improving agents commonly referred to in the literature on diesel fuels can be used. Ether ether has been used to start diesel engines at low temperatures, and various devices have been employed to introduced ethyl ether separately when attempting to start the engine under very low temperature conditions. Ethyl ether has not been used as a blend with conventional diesel fuels but ethyl ether is desirably added in small quantities to methyl ether based diesel fuels to improve cetane number.

Other cetane number improving additives are well known, have been extensively used and are readily available for use to improve the cetane number of dimethyl ether or of mixtures of dimethyl ether with conventional diesel fuels, e.g., petroleum distillates boiling in the range about 400°-600° F. Peroxides, such as hydrogen peroxide, organic peroxides, such as ethyl t-butyl peroxide, di t-butyl peroxide and the like, amyl nitrate and nitromethane function as cetane number improving additives.

Examples of methyl ether containing fuels for use in compression-ignition engines are:

| | | Percent by Weight |
|---|---|---|
| Example 1 | Methyl ether | 95–99 |
| | Cetane improving additive | 1–5 |
| Example 2 | Methyl ether | 50 |
| | Diesel fuel | 48 |
| | Cetane improving additive | 2 |
| Example 3 | Methyl ether | 97 |
| | Ethyl ether | 3 |
| Example 4 | Methyl ether | 50 |
| | Diesel fuel | 49 |
| | Ethyl ether | 1 |
| Example 5 | Methyl ether | 98 |
| | Ethyl t-butyl peroxide | 2 |
| Example 6 | Methyl ether | 59 |
| | Diesel fuel | 49 |
| | Ethyl t-butyl peroxide | 1 |

The fuels of the examples have cetane numbers above 40.

The methyl ether containing fuels above described perform excellently in compression-ignition engines. This performance is due in good part to the fact that methyl ether has a low octane number, 70, and therefore a relatively high cetane number so that mixtures of methyl ether with conventional diesel fuel ignite at low compression ratios. Methyl ether is a clean burning material, its combustion product gases are essentially free of solid particles. The smoky character of the exhaust observed when conventional diesel fuels are used is appreciably reduced when methyl fuels are used.

While methyl ether fuels are especially attractive for diesel engine operation they can also be considered for use in spark ignition engines.

The octane number of methyl ether can be increased to take advantage of the greater efficiency which can be obtained at high compression ratios by addition of water. In addition to using water as an additive to methyl ether, a dual feed system can be employed to meter the water and the methyl ether based fuel separately.

It should be noted that one molecule of water is eliminated from two molecules of methyl alcohol when one molecule of methyl ether is formed. By adding water to methyl ether, forming a mixture rather than a compound, the toxicity of methyl alcohol is avoided, and if less than one molecule of water is added per molecule of methyl ether, the BTU content of the mixture is greater than that of an equal weight of methyl alcohol.

In addition to or instead of using water to improve the octane number of methyl ether, other additives may be employed, for example, methyl t-butyl ether. Although the use of lead compounds to improve octane number is being reduced in the United States, it still would be a valuable anti-knock additive for methyl ether fuels wherever permitted.

Methyl ether containing about 2.5 weight percent water is suitable for use as fuel for a spark ignition engine.

Mixtures of methyl ether with high octane gasoline can be used as fuels for spark ignition engines, for example, a mixture of equal weights of methyl ether and a catalytically reformed gasoline having an octane number in the 80–90 range containing 1 cc per gallon of tetraethyl lead performs adequately as a spark ignition engine fuel.

In recent years propane has come into use as a fuel for spark ignition engines. Means for introducing propane which boils at −42° C. have been developed and are in use. Methyl ether boils at −24° C. and methylether containing fuels could be introduced into vehicle fuel tanks and into the engine using equipment similar to or the same as that now used for handling propane. A mixture of approximately equal weights of propane and methylether is suitable for use as fuel for spark ignition engines.

I claim:

1. A fuel for use in Diesel engine operation, consisting essentially of 95 to 99.9 percent by weight of dimethyl ether and from 0.1 to 5 percent of a cetane number improving additive.

2. A fuel for use in Diesel engine operation consisting essentially of at least fifty percent by weight of the fuel of claim 1 and the remainder conventional hydrocarbon diesel fuel.

3. The fuel defined in claim 1 wherein the cetane number improving additive is an organic peroxide.

4. A fuel for use in Diesel engines consisting essentially of 97 parts by weight of methyl ether and 3 parts by weight of a water containing 10 percent by weight of dissolved hydrogen peroxide.

5. The method of operating a diesel which comprises employing a fuel consisting essentially of methyl ether.

6. The method of operating a diesel engine which comprises continuously injecting into the combustion chamber of the engine during its operation the fuel defined in claim 2.

7. The method of operating a Diesel Engine which comprises continuously injecting into the combustion chamber of the engine a fuel consisting essentially of 95 to 99.9% by weight of dimethyl ether and from 0.1 to 5 percent of a cetane number improving additive selected from the group consisting of hydrogen peroxide, ethyl t-butyl peroxide, di-t-butyl peroxide, amyl nitrate and nitromethane.

* * * * *